US011360423B2

(12) United States Patent
Takagi et al.

(10) Patent No.: US 11,360,423 B2
(45) Date of Patent: Jun. 14, 2022

(54) SHEET CONVEYING APPARATUS AND IMAGE FORMING APPARATUS

(71) Applicant: BROTHER KOGYO KABUSHIKI KAISHA, Nagoya (JP)

(72) Inventors: Takeyuki Takagi, Nagoya (JP); Shota Shinoya, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/081,455

(22) Filed: Oct. 27, 2020

(65) Prior Publication Data

US 2021/0132537 A1 May 6, 2021

(30) Foreign Application Priority Data

Oct. 30, 2019 (JP) ..... JP2019-197699

(51) Int. Cl.
*G03G 15/00* (2006.01)

(52) U.S. Cl.
CPC ... *G03G 15/6579* (2013.01); *B65H 2402/441* (2013.01); *B65H 2601/11* (2013.01)

(58) Field of Classification Search
CPC combination set(s) only.
See application file for complete search history.

(56) References Cited

U.S. PATENT DOCUMENTS

2006/0193666 A1* 8/2006 Tomatsu ..... G03G 15/167 399/401
2010/0247117 A1* 9/2010 Tomatsu ..... B65H 5/26 399/21
2012/0155916 A1* 6/2012 Ito ..... B41J 29/02 49/386
2012/0161385 A1* 6/2012 Haruyama ..... B65H 5/38 271/121
2014/0353908 A1* 12/2014 Kobayashi ..... B65H 5/36 271/226
2017/0217703 A1 8/2017 Yamaguchi

FOREIGN PATENT DOCUMENTS

JP 2012-136311 A 7/2012
JP 2017-132231 A 8/2017

* cited by examiner

*Primary Examiner* — Jennifer Bahls
(74) *Attorney, Agent, or Firm* — Baker Botts L.L.P.

(57) ABSTRACT

A sheet conveying apparatus installed in an image forming apparatus according to the present disclosure includes a first guide member provided to a rear cover and configured to guide a sheet along a conveying path, a second guide member provided to the rear cover and configured to be movable between a first position where the sheet is guided to a nip of intermediate discharging rollers and a second position farther from the nip in a sheet conveying direction than the first position, and a movement mechanism configured to move the second member. When the rear cover is moved from a closed position toward an opened position, the movement mechanism moves the second guide member from the first position to the second position.

5 Claims, 12 Drawing Sheets

SHEET CONVEYING APPARATUS AND IMAGE FORMING APPARATUS

CROSS-REFERENCE TO RELATED APPLICATIONS

This application claims priority under 35 U.S.C. § 119 from Japanese Patent Application No. 2019-197699 filed on Oct. 30, 2019. The entire subject matter of the application is incorporated herein by reference.

BACKGROUND

Technical Field

The present disclosures relate to a sheet conveying apparatus and an image forming apparatus.

An image forming apparatus such as a laser printer typically includes a sheet conveying apparatus having a guide member configured to guide a sheet along a conveying path and a pair of conveying rollers configured to convey the sheet. The sheet conveyed along the conveying path is guided to a nip of the pair of conveying rollers. In this case, in order to suppress occurrence of a sheet jam, it is preferable that an end portion of the guide member is positioned close to the nip of the pair of conveying rollers.

A main body of the image forming apparatus is generally provided with a cover which is rotatable so that jammed sheets can be removed. Further, the guide member mentioned above may be provided to the cover of such an image forming apparatus. In such a configuration, if the end portion of the guide member is arranged close to the nip of the pair of conveying rollers, the end portion of the guide member may contact the conveying rollers when the cover is rotated.

In a conventional technique, in order to resolve the above problem, there has been known a configuration that the guide member is rotatably provided to the main body, and a bearing for a rotating shaft of the guide member is formed in an oval shape. Firstly, the guide member is moved away from the pair of conveying rollers in association with rotation of the cover, and thereafter the guide member is rotated to the opened position. In another conventional configuration, a bearing for a rotating shaft of the cover is formed in an oblong hole shape so that a rotational locus of the cover is made compact.

SUMMARY

In the conventional configuration mentioned above, since the guide member remains on the main body when the cover is opened, it is difficult to remove the jammed sheets in comparison with a configuration where the guide member is provide to the cover. In the other conventional configuration mentioned above, since the entire guide member is moved together with the cover, it is difficult to arrange the guide member at an appropriate position with respect to the pair of conveying rollers.

According to aspects of the present disclosures, there is provided a sheet conveying apparatus including a main body having an opening, a pair of conveying rollers provided to the main body, the pair of conveying rollers being configured to convey a sheet guided along a conveying path, a cover provided to the main body, the cover being rotatable between a closed position where the cover covers the opening and an opened position where the cover uncovers the opening, a movable guide member provided to the cover, the movable guide member being movable between a first position and a second position, the movable guide member being configured to guide the sheet to a nip of the pair of conveying rollers when positioned at the first position, the second position being farther from the nip in a sheet conveying direction than the first position, and a movement mechanism configured to move the movable guide member. In association with movement of the cover from the closed position toward the opened position, the movement mechanism moves the movable guide member from the first position to the second position in order to prevent the movable guide member from interfering with the pair of conveying rollers.

According to aspects of the present disclosures, there is provided an image forming apparatus comprising the above described sheet conveying apparatus, an image forming part configured to form an image on a sheet conveyed by the sheet conveying apparatus, a fixing part configured to fix an image on the sheet, and a pair of reconveying rollers configured to reconveying the sheet, which is transferred to the pair of conveying rollers from the image forming part via the fixing part and switched back by the pair of conveying rollers, to the image forming part. The sheet conveying apparatus comprises an other guide member provided to the cover, the other guide member being configured to guide the sheet along the conveying path. The movable guide member is arranged along the conveying path between the fixing part and the pair of conveying rollers. The guide member is arranged along the conveying path between the pair of conveying rollers and the pair of reconveying rollers.

BRIEF DESCRIPTION OF THE ACCOMPANYING DRAWINGS

DETAILED DESCRIPTION OF THE EMBODIMENT

Hereinafter, as an application example of a sheet conveying apparatus, an illustrative embodiment of an image forming apparatus will be described.

[A Configuration of the Image Forming Apparatus]

Figure 1:
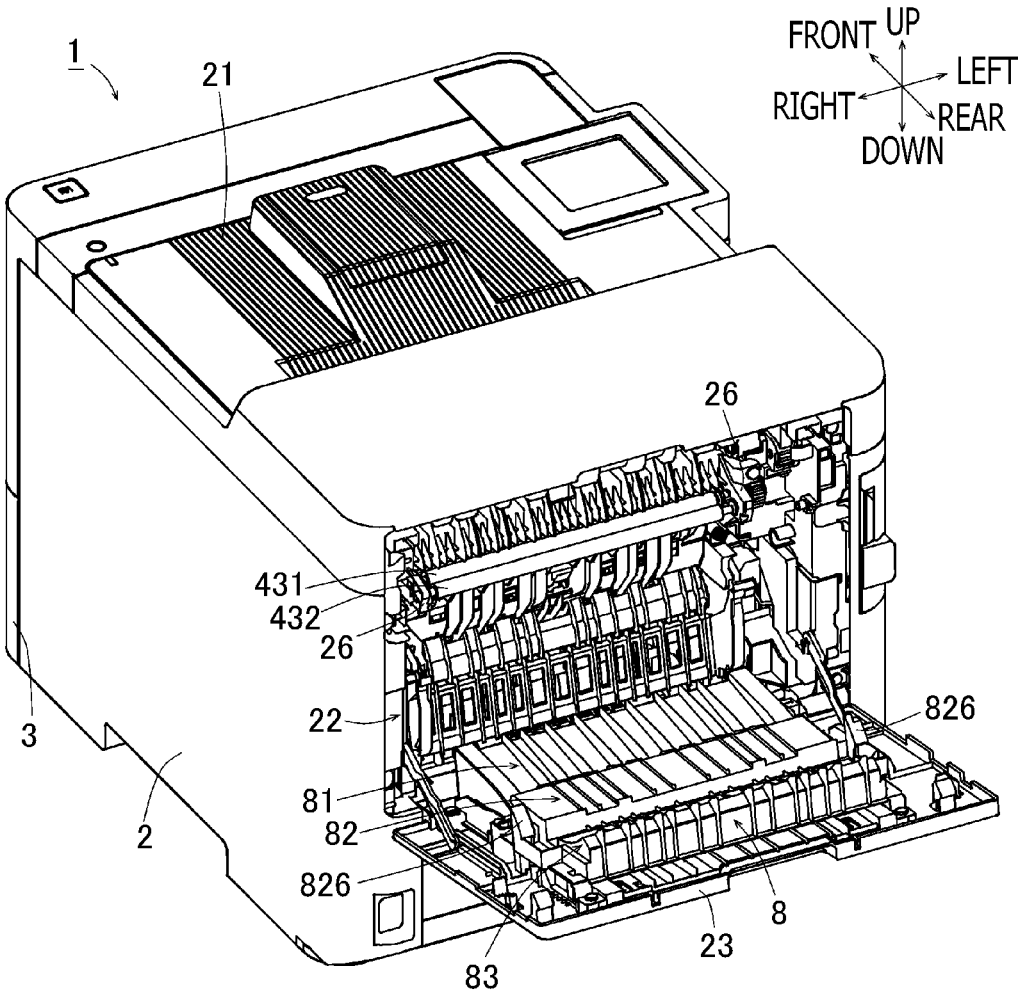
FIG. 1 is a perspective view of an image forming apparatus according to the present disclosures.
Figure 2:
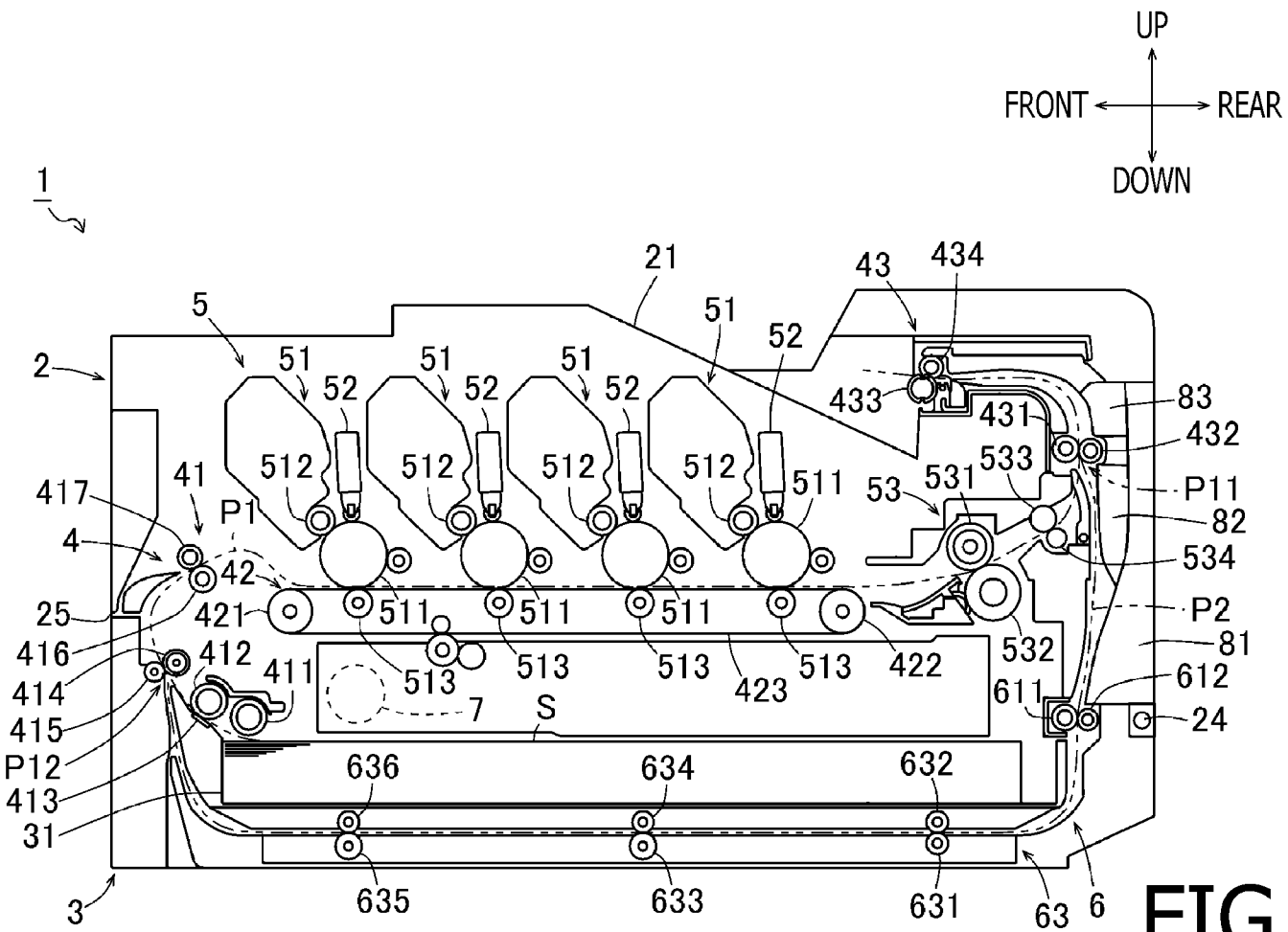
FIG. 2 is a central cross-section view of the image forming apparatus.

FIG. 1 shows a perspective view of the image forming apparatus 1 according to the present disclosures, and FIG. 2 shows a central cross-section view of the image forming apparatus 1. Hereinafter, a criterion state is a state where the image forming apparatus 1 is installed to be usable, a side where a rear cover 23 is provided is a rear side, and an opposite side of the rear side is a front side. A right-left direction is defined by viewing the image forming apparatus 1 from the front side, a side where a discharge tray 21 is provide is defined as an upper side of the image forming apparatus 1, and an opposite side of the upper side is defined as a down side. It noted that the right-left direction of the present embodiment is a width direction perpendicular to a sheet conveying direction.

As shown in FIG. 1, an outside of the image forming apparatus 1 is formed by a main body 2 which is a case having a rectangular shape. On the upper side of the main body 2, the discharge tray 21 configured to support a sheet on which an image is formed is provided. On the rear side of the main body 2, an opening 22 is provided.

To the opening 22 of the main body 2, as an example of a cover, a rear cover 23 is provided. The rear cover 23 is configured to be rotatable between a closed position and an opened position around a rotation shaft 24 (see FIG. 2), which is elongated in the right-left direction, positioning in a lower end of the rear cover 23. The rear cover 23 covers the opening 22 when in the closed position (in a state shown in FIG. 2) and uncovers the opening 22 when in the opened position (in a state shown in FIG. 1). When the sheet jam occurs near the opening 22, by opening the rear cover 23, the jammed sheet can be removed through the opening 22.

As shown in FIG. 2, the image forming apparatus 1 is a color laser printer configured to form an image having multiple colors on a sheet S such as a paper or an OHP sheet by an electrophotographic process. In the main body 2, a sheet cassette 3, a conveying part 4, an image forming part 5, a fixing part 53, a reconveying part 6 and a driving part 7 are accommodated. In the main body 2, the image forming part 5 is generally arranged approximately at an upper and central side, the fixing part 53 is arranged at a rear side of the image forming part 5, the conveying part 4 is arranged at a lower and rear side of the image forming part 5, the sheet cassette 3 is arranged at a lower side of the conveying part 4, the re-sending part 3 is arranged across front and rear parts of the main body 2 and a lower side of the sheet cassette 3, and the driving part 7 is arranged between the image forming part 5 and the sheet cassette 3.

At a front-lower side of the main body 2, an opening 25 which is an insert slot of the sheet cassette 3 is formed. The sheet cassette 3 having a box shape including a top-opened sheet storage 31 and support a plurality of stacked sheets S. The sheet cassette 3 can be inserted/removed with respect to the main body 2 by being moved in the front-rear direction through the opening 25.

The conveying part 4 is consisted of a plurality of parts arranged along a conveying path P1 and is configured to convey the sheet S along the conveying path P1. the conveying path P1 is a path from the sheet cassette 3 to the discharge tray 21 via the image forming part 5. The conveying part 4 is consisted of, in order from an upstream side of the conveying direction of the conveying path P1, a supplying part 41, a belt conveying part 42 and a discharging part 43.

The supplying part 41 includes a supplying roller 411, a separating roller 412, a separating pad 413, conveying rollers 414 and 415 and resist rollers 416 and 417. The sheets S accommodated in the sheet cassette 3 are conveyed one by one to the conveying path P1 by the supplying roller 411, the separating roller 412 and the separated pad 413. The sheet S supplied to the conveying path P1 is transferred toward the image forming part 5 by the conveying rollers 414 and 415 and the resist rollers 416 and 417.

The belt conveying part 42 includes a driving roller 421 rotatable in conjunction with operation of the image forming part 5, a driven roller 422 rotatably arranged at a position separate from the driving roller 521, and a conveying belt 423 wounded around the driving roller 421 and the driven roller 422. The conveying belt 423, upon being rotated in a state where the sheet S is placed thereon, conveys the sheet S along the conveying path P1, to a lower side of a drum unit 55 of the image forming part 5 and toward the fixing part 53.

The discharging part 43 incudes intermediate discharging rollers 431 and 432, which are a pair or rollers arranged between a branch part P11 of the conveying path P1 and the discharge tray 21, and discharging rollers 433 and 434. When the rear cover 23 is in the closed state, an inner surface of the rear cover 23 forms a part of the conveying path P1.

Each of the intermediate discharging rollers 431 and 432 and the discharging rollers 433 and 434 is a switchback roller of which a rotation direction is switchable between a positive direction and an opposite direction. The intermediate discharging rollers 431 and 432 and the discharging rollers 433 and 434 are configure to rotate in the positive direction when discharging the sheet S transferred from the fixing part 53 to the discharge tray 21, and rotate in the opposite direction when flipping and conveying the sheet S toward the reconveying path P2.

The image forming part 5 according to the present embodiment employs the electrophotographic method. Another image forming method such as a thermal method, an inkjet method or the like can be employed. Further, the image forming part 5 employs so-called "direct tandem method," and includes four drum units 51 arranged side-by-side in the front-rear direction and an exposure LED head 52.

The four drum units 51 correspond to black, yellow, magenta and cyan, respectively. Each of the drum units 51 includes a photoconductive drum 511, a developing roller 512 and a transfer roller 513 which is arrange to an opposite side of the photoconductive drum 511 with respect to the conveying belt 423.

In the image forming part 5 as described above, each of the photoconductive drums 511, which is uniformly charged by a charger, is selectively exposed by the exposure LED head 52. By the exposure, electric charge is selectively removed from a surface of each of the photoconductive drums, thereby an electrostatic latent image is formed on the surface of each of the photoconductive drums.

A development bias is applied to each developing roller 512. When the electrostatic latent image formed on each of the photoconductive drums 511 faces to the developing roller 512, by a potential difference between the electrostatic latent image and the developing roller 512, toner is supplied to the electrostatic latent image from the developing roller 512. Thereby, a toner image is formed on a surface of each of the photoconductive drum 511.

The sheet S transferred toward the image forming part 5 is transferred by the conveying belt 423 and sequentially passes between the conveying belt 423 and each of the photoconductive drum 511. The toner image formed on the surface of each of the photoconductive drum 511 is, when facing to the sheet S, transferred to the sheet S by the transfer bias applied to the transfer roller 513.

The fixing part 53 is arranged at a downstream side of the four photoconductive drums 511 in the conveying direction on the conveying path P1. The fixing part 53 includes a heating roller 531 and a pressing roller 532 configured to press the heating roller 531. The heating roller 531 is arranged at a side on which an image is to be formed of the sheet S. The heating roller is rotated in synchronization with the conveying belt 423 and applies a conveying force to the sheet S.

A pressing roller 532 is arranged at an opposite side of the heating roller 531 with respect to the sheet S and is configured to press the sheet S toward the heating roller 531. Thus, the pressing roller 532 is rotated by a rotating force received from the heating roller 531 via the sheet S contacting the heating roller 531.

The fixing part 53 includes fixing and discharging rollers 533 and 534 which is arranged at a downstream side of the heating roller 531 and the pressing roller 532 in the conveying direction of the sheet S.

The sheet S on which the toner image is transferred by the image forming part 5 is transferred to the fixing part 53, the toner image is thermally fixed on the sheet S while the sheet S is transferred through between the heating roller 531 and the pressing roller 532. The sheet S on which the toner image is thermally fixed is transferred to the intermediate discharging rollers 431 and 432 while being sandwiched by the fixing and discharging rollers 533 and 534.

The reconveying part 6 is formed by each element arranged along the reconveying path P2 and is configured to transfer the sheet S along the reconveying path P2. The reconveying path P2 is a path branched from the branch part P11, which is positioned between the fixing part 53 and intermediate discharging rollers 431, 432, and, through a lower side of the sheet cassette 3, jointed to a confluence part P12, which is positioned between the sheet cassette 3 and the image forming part 5.

The reconveying part 6 includes intermediated conveying rollers 611, 612 and a shoot unit 63, which are arranged along a conveying direction of the reconveying path P2. It is noted that the intermediate conveying rollers 611, 612 are examples of a conveying roller. When the rear cover 23 is in the closed state, an inner surface of the rear cover 23 forms a part of the reconveying path P2. The intermediate conveying rollers 611, 612 are conveying rollers configured to convey a sheet toward the shoot unit 63.

The shoot unit 63 includes a plurality of conveying rollers 631-636, which are arranged under the sheet cassette 3, configured to guide the sheet along the reconveying path P2. The shoot unit 63 is configured to transfer the sheet S conveyed from the intermediate conveying rollers 611, 612 to the confluence part P12. The sheet S, which is again conveyed to the image forming part 5 from the confluence part P12, is discharged to the discharge tray 21 through the discharging part 43 after an image is formed on the other side of the sheet S.

As described above, according to the image forming apparatus 1, since the sheet S of which an image is formed on one side by the image forming part 5 is conveyed to the image forming part 5 again through the reconveying path P2, it is possible to form an image on the other side of the sheet S (i.e., both-side printing can be executed).

The driving part 7 is composed of an electric motor or the like and is arranged at an upper side of the sheet unit 63. Driving force of the driving part 7 is transferred to each element through a driving force transfer mechanism.

Hereinafter, a configuration that a guide member is provided to the rear cover 23 to make it easier to remove the sheet jam will be described. Further, a movement mechanism will be described. The movement mechanism is configured to make the guide member not interfere with the intermediate discharging rollers 431, 432 when the rear cover 23 is rotated even if a leading edge of the guide member is arranged near the nip of the intermediate discharging rollers 431, 432. Furthermore, a configuration that the guide member can be arranged at an appropriate position with respect to the intermediate conveying rollers 611, 612 will be described.

[Guide Member and Movement Mechanism]

Figure 3:
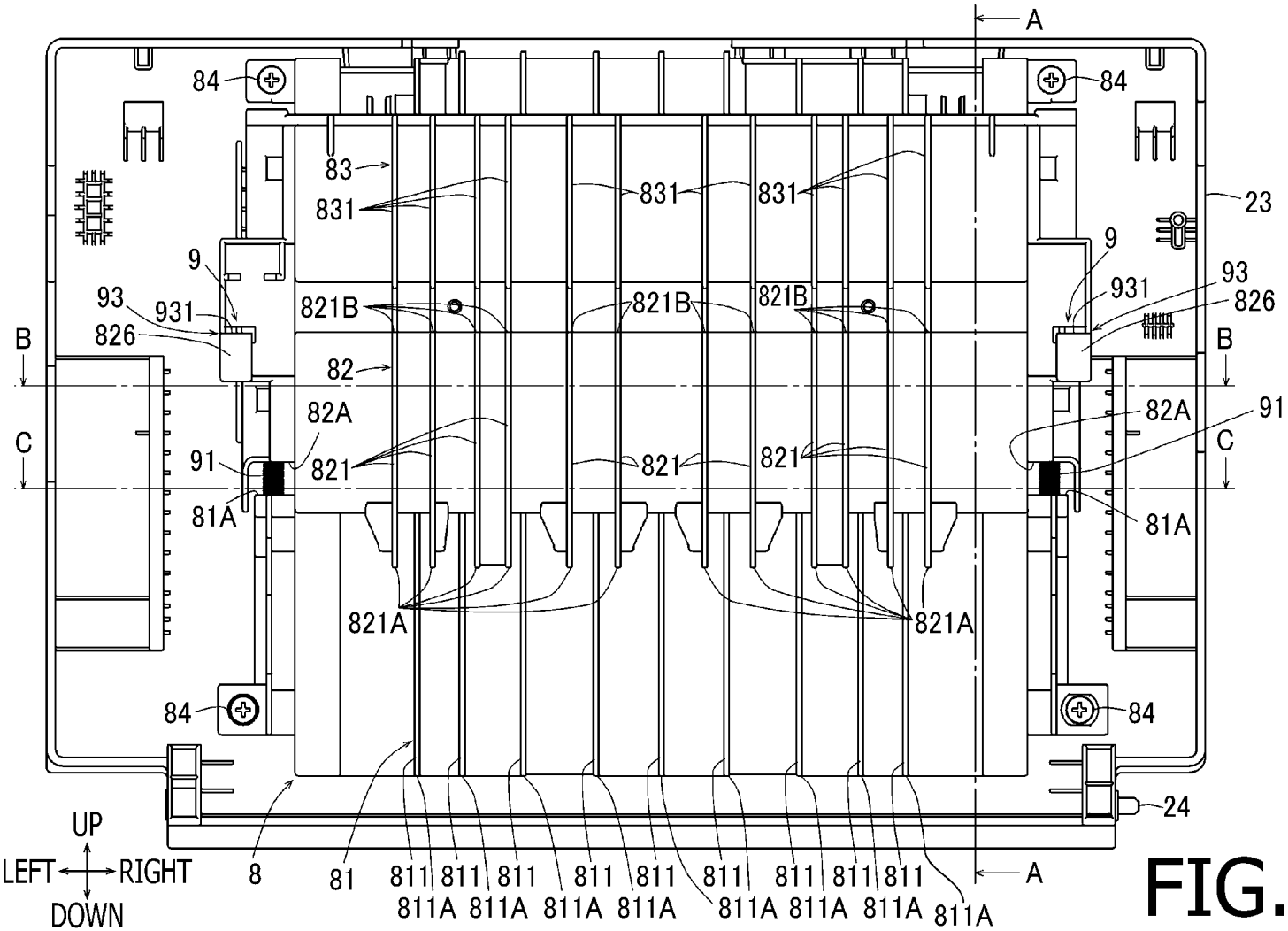
FIG. 3 is a front view of a rear cover.
Figure 4:
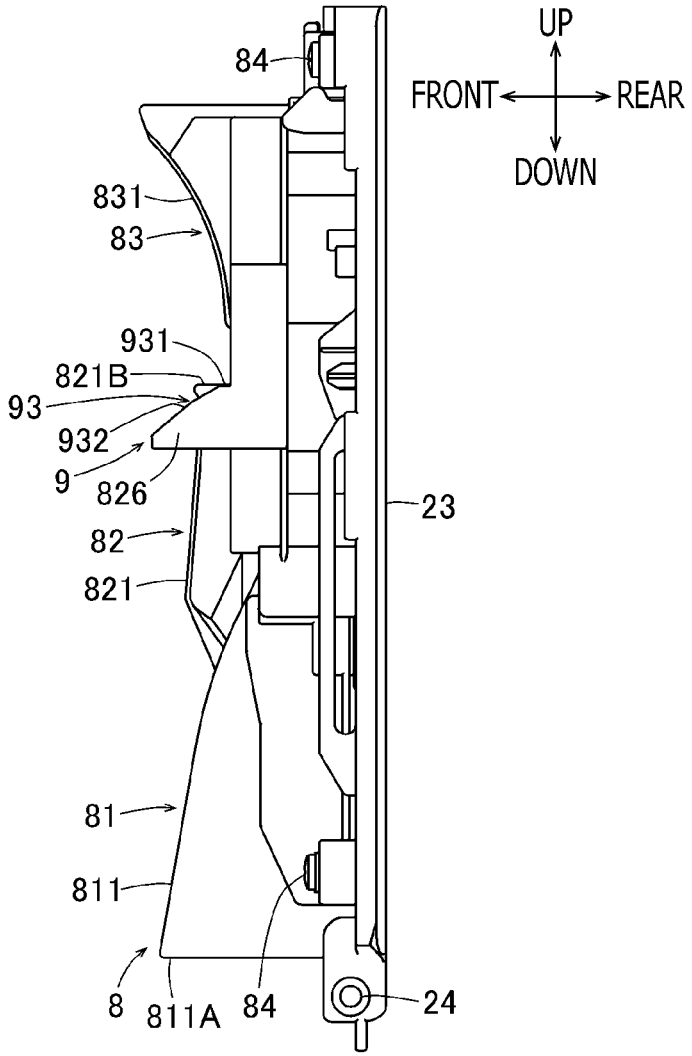
FIG. 4 is a right-side view of the rear cover.
Figure 5:
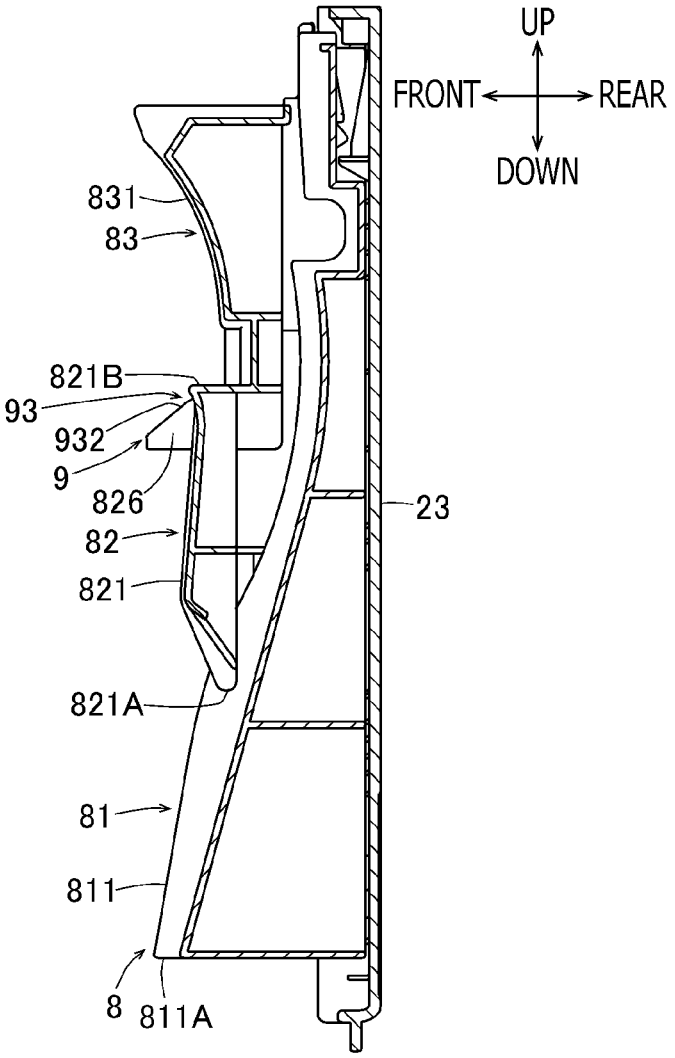
FIG. 5 is a cross-section view at a line A-A indicated in FIG. 3.
Figure 6:
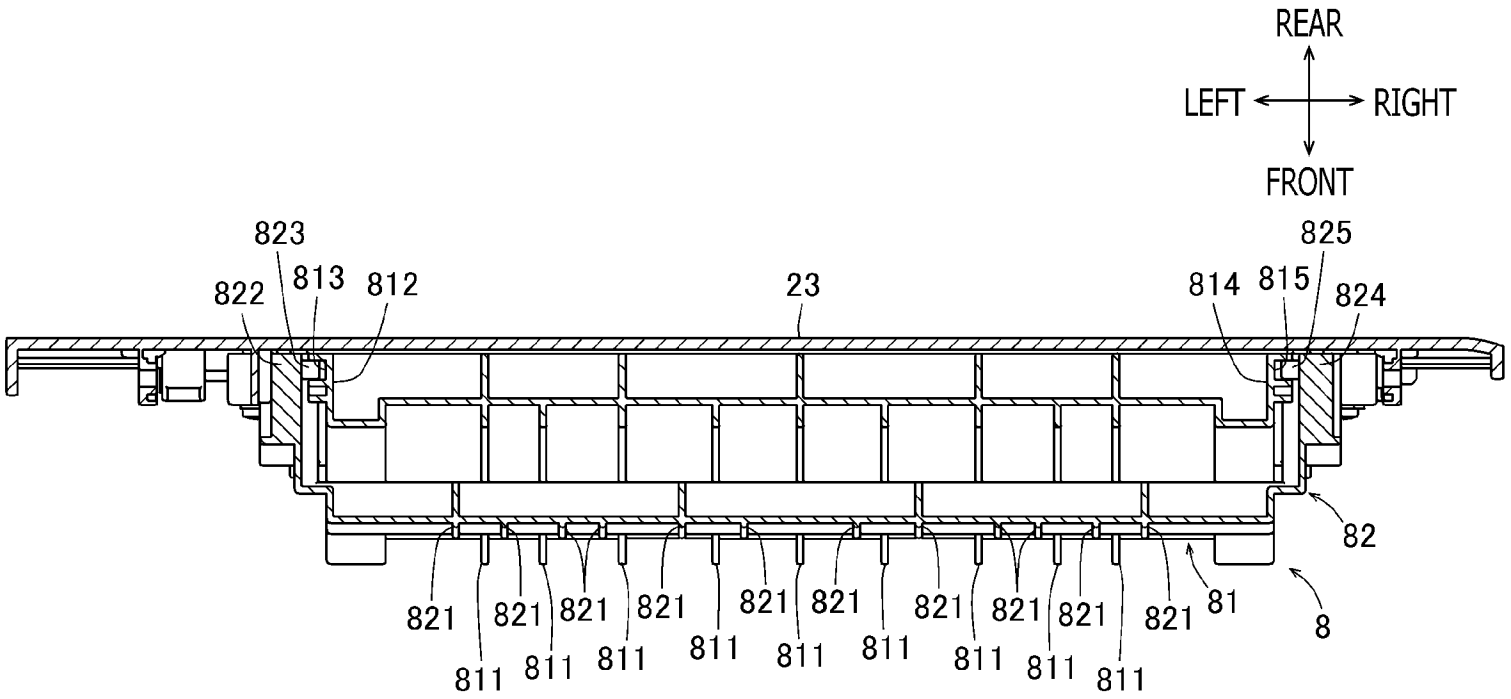
FIG. 6 is a cross-section view at a line B-B indicated in FIG. 3.
Figure 7:
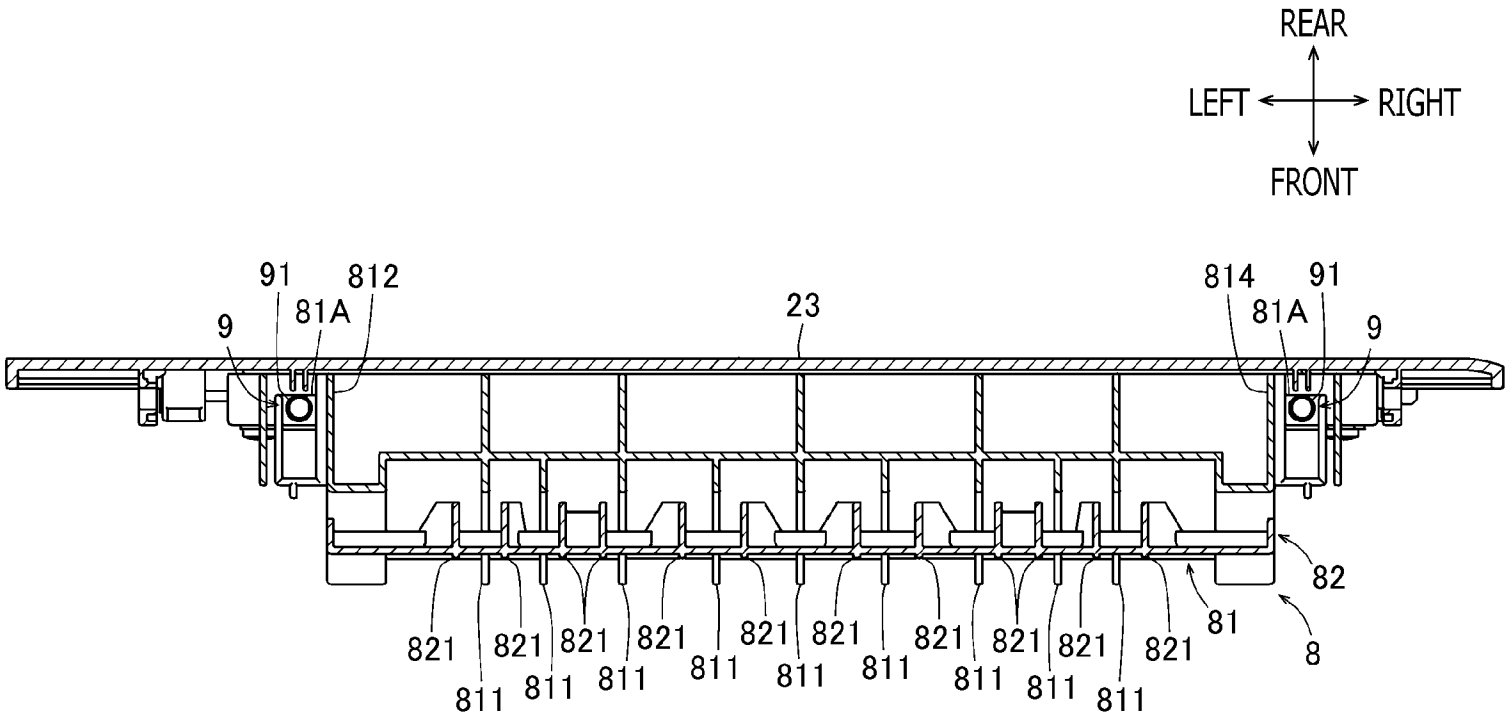
FIG. 7 is a cross-section view at a line C-C indicated in FIG. 3.
Figure 8:
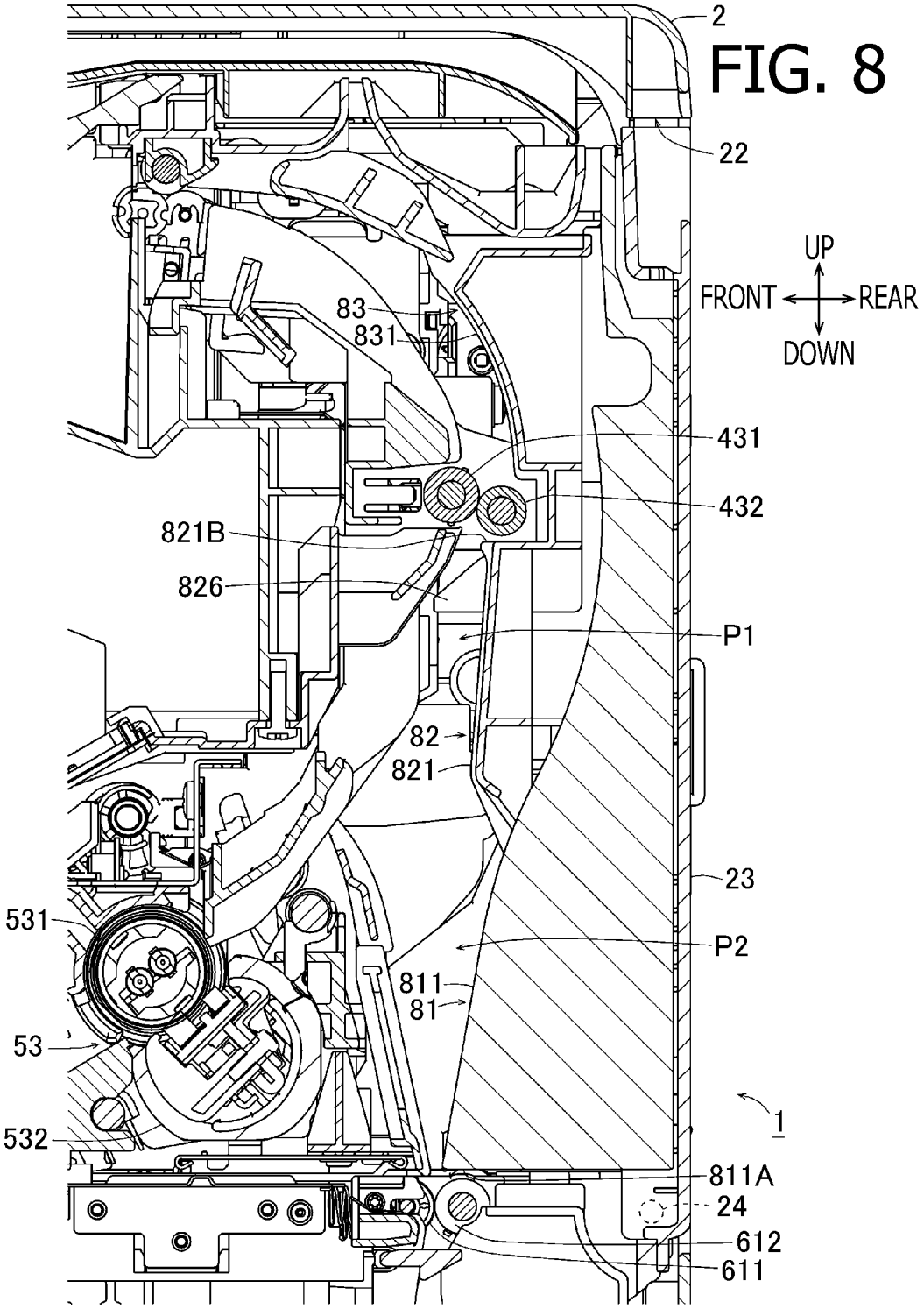
FIG. 8 is a central cross-section view around the rear cover when the rear cover is in a closed state.
Figure 9:
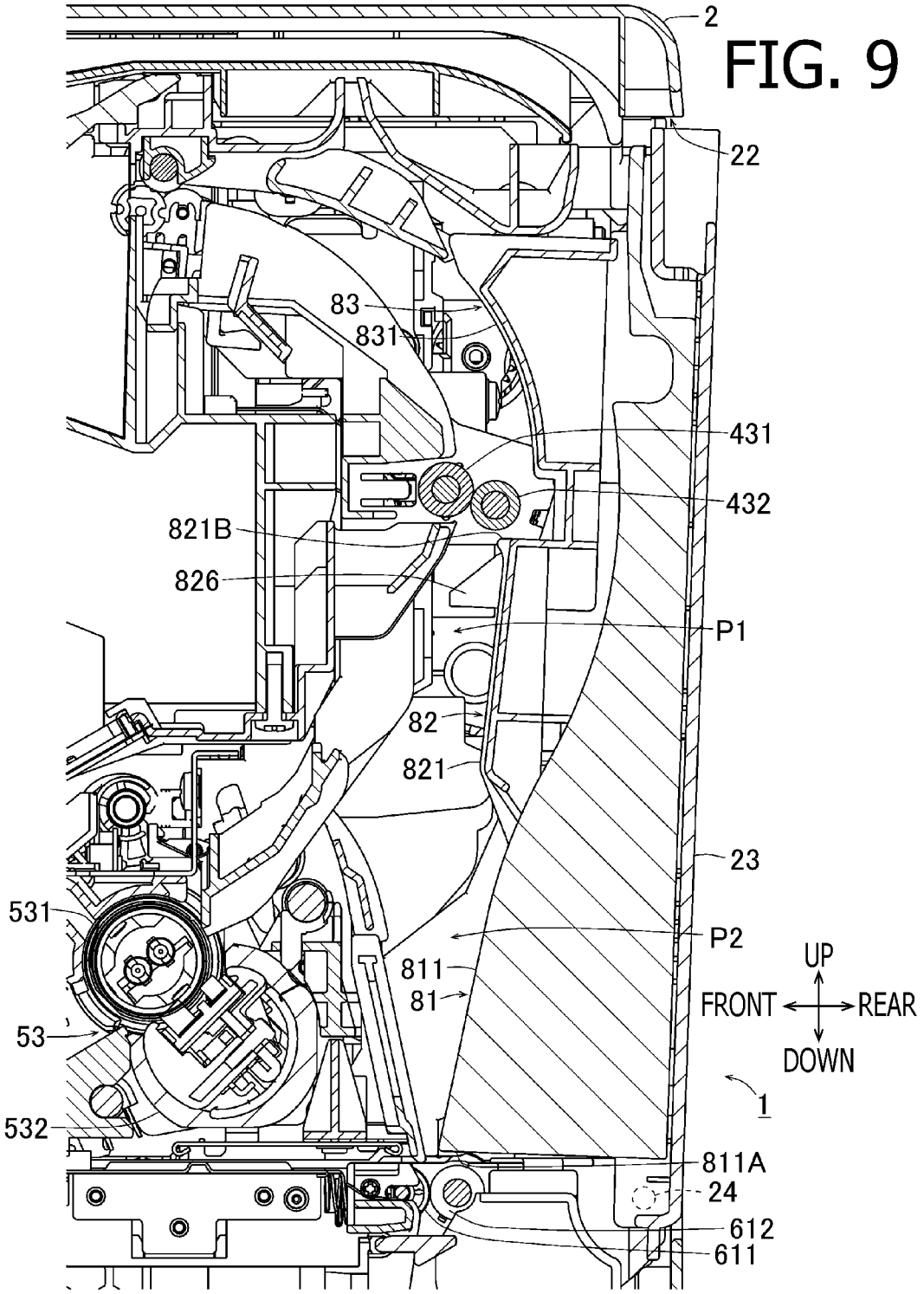
FIG. 9 is a state where the rear cover shown in FIG. 8 is in a position near the closed position.
Figure 10:
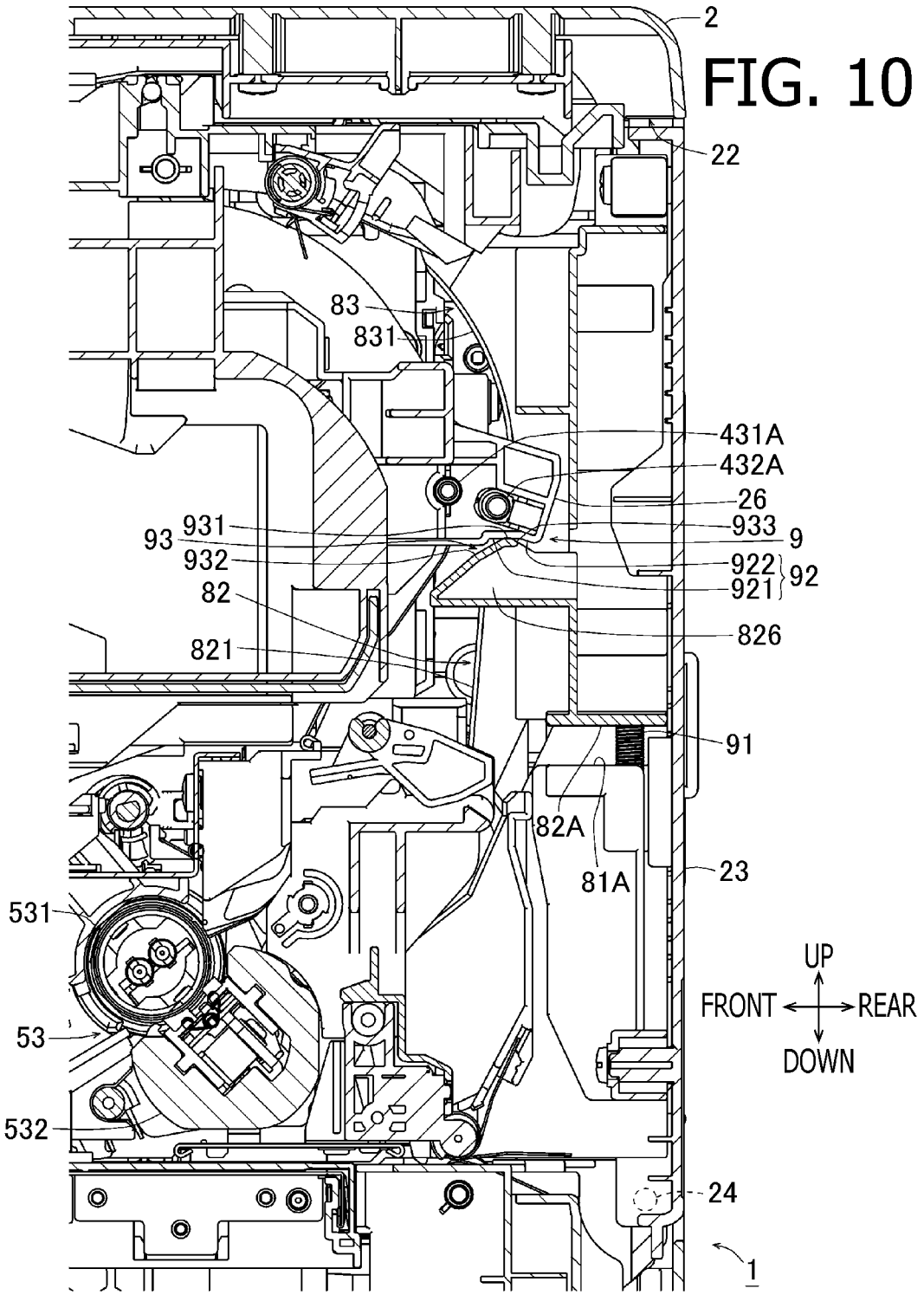
FIG. 10 is a cross-section view around a movement mechanism when the rear cover is in the closed position.
Figure 11:
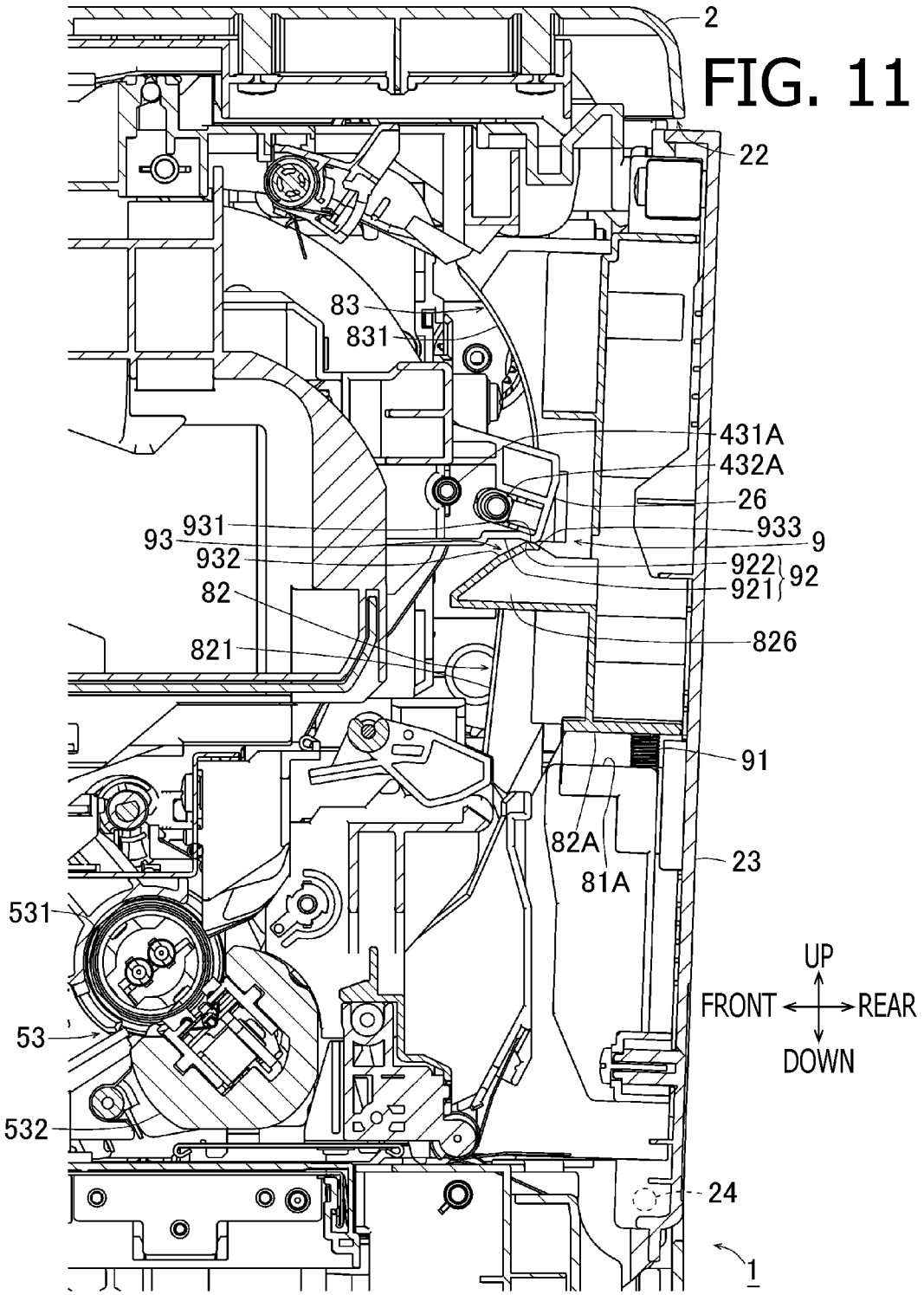
FIG. 11 is a state where the rear cover shown in FIG. 10 is in a position near the closed position.

FIG. 3 shows a front view of the rear cover 23, FIG. 4 shows a right-side view of the rear cover 23, FIG. 5 shows a cross-section view at a line A-A indicated in FIG. 3, FIG. 6 shows a cross-section view at a line B-B indicated in FIG. 3, FIG. 7 shows a cross-section view at a line C-C indicated in FIG. 3, FIG. 8 shows a central cross-section view around the rear cover 23 when the rear cover 23 is in the closed state, FIG. 9 shows a state where the rear cover 23 shown in FIG. 8 is in a position near the closed position, FIG. 10 shows a cross-section view around the movement mechanism 9 when the rear cover is in the closed position, and FIG. 11 shows a state where the rear cover 23 shown in FIG. 10 is in a position near the closed position.

<Guide Member>

As shown in FIGS. 3, 4 and 8, the rear cover 23 is provided to a guide member 8 configured to guide the sheet S along the conveying path P1 and the reconveying path P2. Further, the rear cover 23 and the main body 2 are provided to a movement mechanism 9 configured that the guide member 8 does not interfere with the intermediate discharging roller 431, 432 when the rear cover 23 is rotated.

The member 8 includes a first guide member 81, a second guide member 82 and a third guide member 83. The first guide member 81 is fixed to an inner surface of the rear cover 23 by screws. The first guide member 81 has multiple first guide ribs 811 which are arranged along the conveying path P1 and the reconveying path P2 between the intermediate discharging rollers 431, 432 and the intermediate conveying rollers 611, 612, and elongated in the sheet conveying direction. The sheet S is guided while slidably contacting the first guide ribs 811. The first guide member 81, The second guide member 82 and The third guide member 83 are examples of an other guide member, a movable guide member and a downstream guide member.

A lower end part 811A of each of the first guide ribs 811 elongates until a position near the nip of the intermediate conveying roller 611, 612. Thus, since the first guide member 81 does not move, it is possible to arrange the first guide ribs 811 at an appropriate position with respect to the intermediate conveying roller 611, 612. Therefore, occurrence of the sheet jam at the intermediate conveying rollers 611, 612 can be suppressed.

As shown in FIG. 8, since a rotation shaft 24 of the rear cover 23 is arranged at a rear side with respect to the intermediate conveying rollers 611, 612, lower end parts 811 A of the first guide ribs 811, which is positioned at an upper side with respect to the intermediate conveying rollers 611, 612, does not interfere with the intermediate conveying rollers 611, 612 when the rear cover 23 is opened and closed.

As shown in FIGS. 3, 4 and 8, the second guide member 82 includes multiple second guide ribs 821 which are arranged along the conveying path P1 between the fixing part 53 and the intermediate discharging rollers 431, 432 and elongated in the sheet conveying direction. The sheet S is guided while slidably contacting the second guide ribs 821.

The second guide member 82 is movably connected with the first guide member 81. Specifically, as shown in FIG. 6, the second guide member 82 has a protruding part 823 protruding rightward from a right surface of a right-side wall 822 of the guide member 82 and a protruding part 825 protruding leftward from a left surface of a left-side wall 824. Each of the protruding parts 823, 825 has a cylindrical shape. The first guide member 82 has a recessed groove 813 formed on a left surface of a left-side wall 812 of the first guide member 82 and a recessed groove 815 formed on a right surface of a right-side wall 814 of the first guide member 82. Each of the recessed grooves 813 and 815 elongate in the up-and-down direction.

As the protruding part 823 engages with the recessed groove 813 and slides in the up-and-down direction, and the protruding part 825 engages with the recessed groove 815 and slides in the up-and-down direction, the second guide member 82 slides in the up-and-down direction with respect to the first guide member 81. Thus, the second member 82 can be moved between a first position where the sheet S is guide to the nip of the intermediate discharging roller 431, 432 (a position indicated in FIG. 8) and a second position farther from the nip toward a downstream side in the sheet conveying direction than the first position (a position indicated in FIG. 9).

As shown in FIG. 3, each of the second guide ribs 821 is arranged at a position different from positions of the first guide ribs in the right-left direction. As shown in FIG. 5, the lower end part 821A of each of the second guide ribs 821 is arranged at a position at least partially overlapping the first guide rib 811 when viewed from a right side.

Thus, it is possible to smoothly convey the sheet S between the first guide ribs 811 and the second guide ribs 821. It is noted that the second guide ribs 821 may be arranged at the same positions as the first guide ribs 811 in the right-left direction, respectively. Further, the second guide ribs 821 may be arranged at a position which does not overlap the first guide member 811 when viewed from a right side.

As shown in FIGS. 3, 4 and 8, the third guide member 83 is arranged at an upper position on an opposite side of the intermediate discharging rollers 431, 432 with respect to the second guide member 82. That is, the third guide member 83 is arranged at a downstream side with respect to the nip of the intermediate discharging rollers 431, 432. Further, the third guide member 83 is integrally formed with the second guide member 82. The third guide member 83 has multiple third guide ribs 831 extending in the sheet conveying direction. The sheet S is guided while slidably contacting the third guide ribs 831. The intermediate discharging rollers 431, 432 are an example of a pair of conveying rollers.

Since the third guide member 83 is integrally formed with the second guide member 82, positioning accuracy of the third guide member 83 with respect to the second guide member 82 becomes high, and it is possible to reduce the number of parts. The third guide member 83 may be formed separately from the second guide member 82.

As described above, since the first guide member 81, the second guide member 82 and the third guide member 83 are provided to the rear cover 23, part of the conveying path P1 and part of the reconveying path P2 can be released by moving the rear cover 23 to the opened position, and thereby, when the sheet jam occurs, it is possible to easily remove the sheet jam.

<Movement Mechanism>

As shown in FIGS. 10 and 11, the main body 2 includes a holder 26, as one element consisting the movement mechanism 9, configured to support the intermediate discharging roller 431, 432. The holder 26 is arranged at each side of the main body 2 in the right-left direction, and the holders 26 support rotation shafts 431A, 432A of the intermediate discharging rollers 431, 432, respectively.

The movement mechanism 9 is a mechanism configured to move the second guide member 82 from the first position to the second position in order to prevent that the second guide member 82 from interfering with the intermediate discharging rollers 431, 432 when the rear cover 23 is moved from the closed position toward the opened position. As shown in FIGS. 3, 7, 10 and 11, the movement mechanism 9 includes a pressing member 91, a first cam and a second cam 93.

The pressing member 91 is configured to press the second guide member 82 from the second position toward the first position. An elastic body such as a compressed coil spring as shown in FIGS. 3, 7 and 11, rubber or the like can be used as the pressing member 91. The pressing member 91 is arranged at each side in the right-left direction. A lower end of the pressing member 91 contacts an upper surface 81A of each side of the first guide member 81 in the right-left direction, and an upper end of the pressing member 91 contacts a lower surface 82A of each side of the second guide member 82 in the right-left direction.

The first cam 92 is a cam provided on the holder 26. As shown in FIGS. 10 and 11, the first cam 92 of the present embodiment is a recess formed on a lower surface of the holder 26 and has a first cam surface 921 and a second cam surface 922. The first cam surface 921 is a horizontal plane positioned at a lower side with respect to the intermediate discharging roller 432. The second cam surface 922 is an inclined plane extended backward and downward from a rear end of the first cam surface 921.

The second cam 93 is a cam provided on the second guide member 83. As shown in FIGS. 3, 10 and 11, the second cam 93 of the present embodiment is a protrusion formed on an upper surface of a protruding part 826 protruding forward from each end portion, in the right-left direction, of the second guide member 82. The second cam 93 has a third cam surface 931, a fourth cam surface 932 and a fifth cam surface 933.

When the rear cover 23 is in the closed position as shown in FIG. 10, the third cam surface 931 is a horizontal plane contacting the first cam surface 921. The fourth cam surface 932 is an inclined plane extended forward and downward from a front end of the third cam surface 931. The fifth cam surface 933 is an inclined plane extended backward and downward from a rear end of the third cam surface 931.

With this configuration of the movement mechanism 9, as shown in FIG. 10, when the rear cover 232 is in the closed state, the third cam surface 931 of the second cam 93 contacts the first cam surface 921 of the first cam, and the second guide member 82 is positioned in the first position by the pressing force of the pressing member 91. When the rear cover 23 is rotated from this state toward the opened position, the protruding part 826 is moved backward, and thereby the third cam surface 931 is moved backward while slidably contacting the first cam surface 921.

Then, when a rear end of the third cam surface 931 is moved backward while slidably contacting the second cam surface 922, as shown in FIG. 11, the protruding part 826 is pressed down by the second cam surface 922. In FIG. 11, the second guide member 82 is pressed down against the pressing force from the pressing member 91 and position in the second position.

When the rear cover 23 is rotated toward the opened position from the position shown in FIG. 11, the third cam surface 931 slidably contacts a rear end of the second cam surface 921, then the fifth cam surface 933 slidably contacts a rear end of the second cam surface 921. Thus, the second guide member 82 is returned to the first position by the pressing forth of the pressing member 91.

That is, when the rear cover 23 starts to move from the closed position toward the opened position, as shown in FIGS. 10 and 11, the second guide member 82 moves from the first position to the second position against the pressing force from the pressing member 91 while the second cam 93 slidably contacting the first cam 92.

Thus, when the rear cover 23 starts to move from the closed position toward the opened position, as shown in FIGS. 8 and 9, as the second guide member 82 moves from the first position to the second position, upper end parts 821B of the second guide ribs 821 moves away from the intermediate discharging roller 432.

Therefore, even if the upper end parts 821B of the second guide ribs 821 are arranged near the nip of the intermediate discharging rollers 431, 432, the upper end parts 821B do not interfere with the intermediate discharging roller 432 when the rear cover 23 is rotated. On the other hand, when the rear cover 23 moves from the closed position toward the opened position, a movement becomes reverse of the above.

Further, as described above, since the first cam 92 configured to slidably contact the second cam 93 is arranged on the holder 29 configured to support the intermediate discharging roller 431, 432, it is possible to arrange, with high accuracy, the second guide member 82 with respect to the nip of the intermediate discharging rollers 431, 432. It is noted that the first cam 92 may be arranged on a part other than the holder 26 of the main body 2.

Further, contrary to the configuration of the first cam 92 and the second cam 93 described above, the first cam 92 may be configured by a protrusion and the second cam 93 may be configured by a recess.

In the above described embodiment, although the opening 22 is formed on a rear surface of the main body 2, the opening 22 may be formed on a front surface, a right surface, a left surface or an upper surface of the main body 2. A cover is provided on a surface where the opening 22 is formed. In this case, a destination to which the second guide member provided on the cover guides the sheet may not be the intermediated discharging rollers 431, 432 and may be another conveying roller facing the opening.

Although the image forming apparatus is described as an example in the above embodiment, the present disclosures can be applied to an apparatus other than an image forming apparatus such as an image reading apparatus as long as it is a sheet conveying apparatus configured to convey the sheet in the main body having the opening.

[Modifications]

Figure 12:
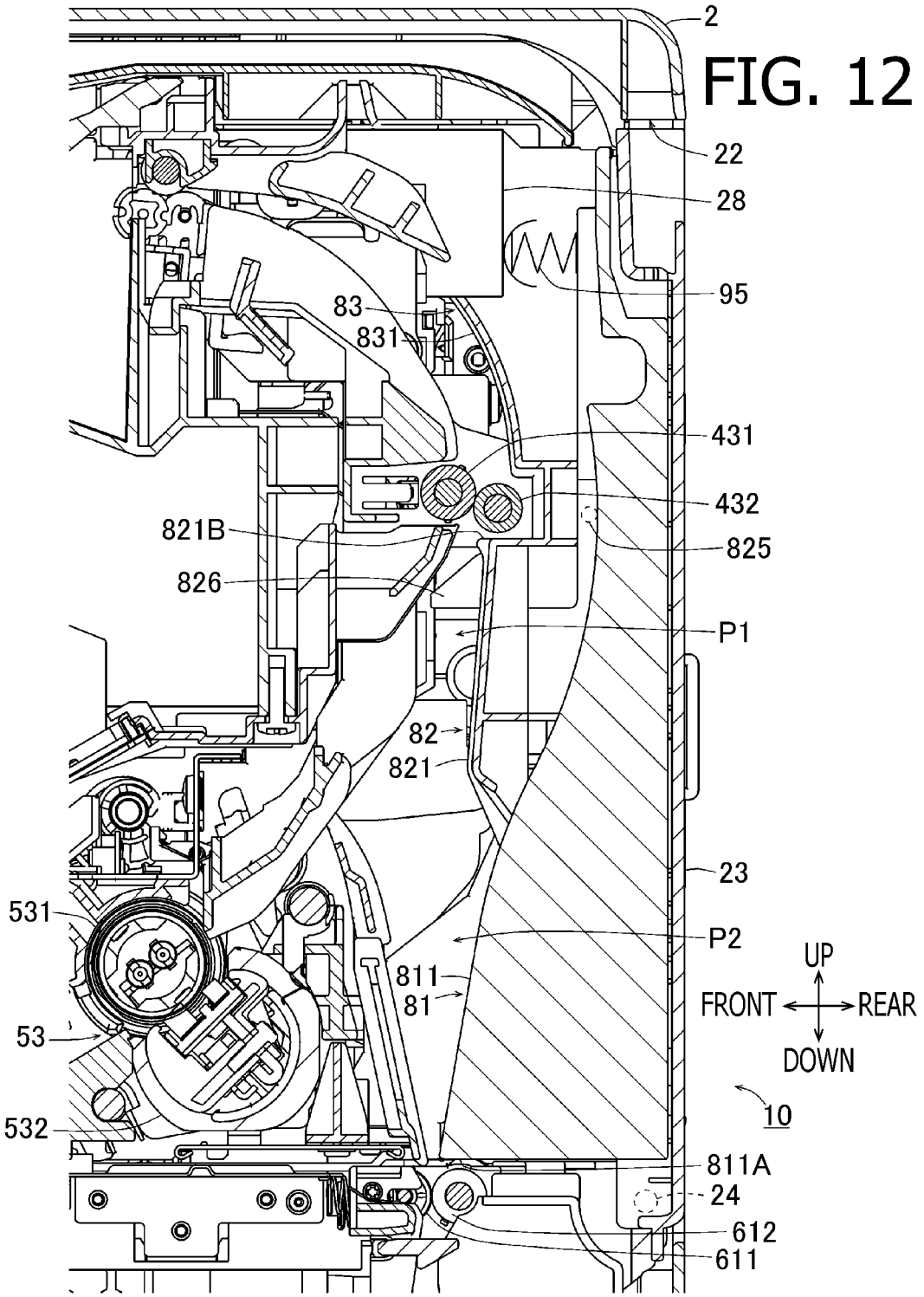
FIG. 12 is a central cross-section view of around the rear cover of the image forming apparatus according to a modification of the present disclosures.

FIG. 12 shows a central cross-section view of around the rear cover 23 of the image forming apparatus 10 according to a modification of the present disclosures.

The second guide member 82 is configured to be rotated, and the image forming apparatus 10 includes a rotation shaft 825, a pressing member 95 and a contacting part 28. The rotation shaft 825 is a shaft elongated from the second guide member 82 in the right-left direction, and rotatably supported by the first guide member 81. The rotation shaft 825 is arranged at a rear side with respect to the intermediate discharging rollers 431, 432.

The pressing member 95 is a member configured to press the second guide member 82 from the second position toward the first position. An elastic body such as a compressed coil spring as shown in FIG. 12, rubber or the like can be used as the pressing member 95. The pressing member 95 is arranged at each of right and left sides of an upper end of the third guide member 83 which is integrally formed with the second guide member 82. The contacting part 28 is provided on the main body 2. A rear end of the pressing member 95 is fixed to the third guide member 83. The contacting part 28 is provided at a position where a frond end of the pressing member 95 contacts when the rear cover 23 is in the closed position.

Thus, the second guide member 82 is in the first position (i.e., a position shown in FIG. 12) when the rear cover 23 is in the closed position. When the rear cover 23 starts to rotate from the closed position toward the opened position, the pressing member 9 is moved away from the contacting part 28. And, the guide member 28 rotates around the rotation shaft 825 by own weight such that the upper end parts 821B of the second guide ribs 821 moves away from the intermediate discharging roller 432.

Therefore, similar to the above described image forming apparatus 1, even if the upper end parts 821*b* of the second guide ribs 821 are arranged near the nip of the intermediate discharging rollers 431, 432, the upper end parts 81B of the second guide ribs 821 do not interfere with the intermediate discharging roller 432 when the rear cover 23 is rotated.

What is claimed is:

1. A sheet conveying apparatus comprising:

a main body having an opening;

a pair of conveying rollers provided to the main body, the pair of conveying rollers being configured to convey a sheet guided along a conveying path;

a cover provided to the main body, the cover being rotatable between a closed position where the cover covers the opening and an opened position where the cover uncovers the opening;

a movable guide provided to the cover, the movable guide being rotatable in conjunction with the cover such that the cover and the movable guide open and close the opening, the movable guide being movable with respect to the cover between a first position and a second position, the movable guide being configured to guide the sheet to a nip of the pair of conveying rollers when the cover is positioned in the closed position and the movable guide is positioned in the first position, the second position being farther from the nip in a sheet conveying direction than the first position; and a movement mechanism configured to move the movable guide with respect to the cover, wherein, when the cover is rotated with the movable guide from the closed position toward the opened position, the movement mechanism moves the movable guide from the first position to the second position in order to prevent the movable guide from interfering with the pair of conveying rollers.

2. The sheet conveying apparatus according to claim 1, wherein the main body has a holder configured to support the pair of conveying rollers, wherein the movement mechanism includes:

a pressing member configured to press the movable guide from the second position toward the first position;

a first cam provided to the holder; and a second cam provided to the movable guide, wherein, when the cover is moved from the closed position toward the opened position, the movable guide moves from the first position to the second position against pressing force of the pressing member while the second cam slidably contacts the first cam.

3. The sheet conveying apparatus according to claim 1, comprising a downstream guide arranged at an opposite side of the movable guide with respect to the pair of conveying rollers, the downstream guide being configured to guide the sheet along the conveying path.

4. An image forming apparatus comprising:

the sheet conveying apparatus according to claim 1;

an image forming part configured to form an image on a sheet conveyed by the sheet conveying apparatus;

a fixing part configured to fix an image on the sheet; and a pair of reconveying rollers configured to reconvey the sheet, which is transferred to the pair of conveying rollers from the image forming part via the fixing part and switched back by the pair of conveying rollers, to the image forming part;

wherein the sheet conveying apparatus comprises an other guide provided to the cover, the other guide being configured to guide the sheet along the conveying path;

wherein the movable guide is arranged along the conveying path between the fixing part and the pair of conveying rollers, and wherein the other guide is arranged along the conveying path between the pair of conveying rollers and the pair of reconveying rollers.

5. The image forming apparatus according to claim 4, wherein the other guide has a first guide rib extended in the sheet conveying direction, wherein the movable guide has a second guide rib extended in the sheet conveying direction, the second guide rib being arranged at a position different from a position of the first guide rib in a width direction perpendicular to the sheet conveying direction, and wherein the second guide rib is arranged at a position at least partially overlapping the first guide rib when viewed from the width direction.

* * * * *